US007621719B2

(12) United States Patent
Lutjen et al.

(10) Patent No.: US 7,621,719 B2
(45) Date of Patent: Nov. 24, 2009

(54) MULTIPLE COOLING SCHEMES FOR TURBINE BLADE OUTER AIR SEAL

(75) Inventors: Paul M. Lutjen, Kennebunkport, ME (US); Gary Grogg, South Berwick, ME (US); Christopher Joe, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 671 days.

(21) Appl. No.: 11/240,192

(22) Filed: Sep. 30, 2005

(65) Prior Publication Data

US 2007/0248462 A1 Oct. 25, 2007

(51) Int. Cl.
*F01D 11/08* (2006.01)

(52) U.S. Cl. ..... 415/173.1; 415/176

(58) Field of Classification Search ..... 415/116, 415/173.1, 175–178

See application file for complete search history.

(56) References Cited

U.S. PATENT DOCUMENTS 4,526,226 A * 7/1985 Hsia et al. ..... 165/109.1
5,486,090 A * 1/1996 Thompson et al. ..... 415/173.1
5,609,469 A * 3/1997 Worley et al. ..... 415/173.1
5,649,806 A * 7/1997 Scricca et al. ..... 415/115
5,993,150 A * 11/1999 Liotta et al. ..... 415/115
6,146,091 A * 11/2000 Watanabe et al. ..... 415/115
6,705,831 B2 * 3/2004 Draper ..... 415/115
7,033,138 B2 * 4/2006 Tomita et al. ..... 415/139
7,306,424 B2 * 12/2007 Romanov et al. ..... 415/115
2007/0041827 A1 * 2/2007 Camus ..... 415/116

* cited by examiner

*Primary Examiner*—Edward Look
*Assistant Examiner*—Ryan H Ellis
(74) *Attorney, Agent, or Firm*—Carlson, Gaskey & Olds

(57) ABSTRACT

A blade outer air seal is provided with a plurality of distinct cooling circuit schemes. Preferably, compact heat exchanger structures are utilized, and can be individually tailored to the particular location along the blade outer air seal. As an example, a greater pressure ratio exists between the products of combustion and the cooling air at the trailing edge than would be found at the leading edge. The present invention takes advantage of this distinction by utilizing cooling schemes that have a greater pressure drop at the trailing edge than the cooling schemes utilized closer to the leading edge.

18 Claims, 2 Drawing Sheets

MULTIPLE COOLING SCHEMES FOR TURBINE BLADE OUTER AIR SEAL

This invention was made with government support under Contract No. F33615-03-D-2354-0002 awarded by the United States Air Force. The government therefore has certain rights in this invention.

BACKGROUND OF THE INVENTION

This application relates to an improved cooling circuit for a blade outer air seal, in which a plurality of distinct cooling schemes are utilized.

Gas turbine engines are provided with a number of functional sections, including a fan section, a compressor section, a combustion section, and a turbine section. Air and fuel are combusted in the combustion section. The products of the combustion move downstream, and pass over a series of turbine rotors, driving the rotors to create power.

It is desirable to have the bulk of the products of combustion pass over the turbine blade. Thus, a seal is placed circumferentially about the turbine rotors slightly radially spaced from a radially outer surface of the turbine blades. The seal is in a harsh environment, and must be able to withstand high temperatures. To address the high temperatures, the seal is typically provided with internal cooling channels. Air circulates through the cooling channels to cool the seal.

In the prior art, one type of cooling scheme has been utilized across the seal. However, the cooling challenges faced across the seal vary. As an example, the seal extends from a leading edge to a trailing edge. A pressure ratio between the cooling air and the working air is low at the leading edge, and greater at the trailing edge. Even so, the prior art has not tailored the cooling channels to the location. Further, the prior art has typically used only relatively large cooling channels in the blade outer air seals.

More recently, compact heat exchanger cooling schemes (or microcircuit cooling channels) have been developed, which utilize relatively thin and small passages to convey cooling air through a body. These compact heat exchangers are formed by lost core molding techniques. While these techniques provide efficient and effective cooling, they have not been applied to a cool blade outer air seal.

SUMMARY OF THE INVENTION

In the disclosed embodiment of this invention, a blade outer air seal is provided with a cooling channels that utilizes at least a plurality of distinct cooling schemes. In the disclosed embodiment, all of the cooling schemes utilized across the blade outer air seal are of the compact heat exchanger type. Of course, other type cooling schemes, such as the prior art (FIG. 1) scheme formed by ceramic casting technology, can be utilized. In one embodiment, there are cooling schemes utilized adjacent the trailing edge of the blade outer air seal which will result in a relatively great pressure drop. The cooling schemes vary to decrease this pressure drop, moving in a direction towards the leading edge. As mentioned, the pressure ratio is greater at the trailing edge, and a higher pressure drop is acceptable.

As an example, one type of a cooling scheme which might be utilized adjacent the trailing edge includes a plurality of tortuous paths, and extends through a relatively long distance measured in a direction from the trailing edge to the leading edge. Air enters through passages at an outer peripheral surface of a body of the seal, passes through the tortuous path, and exits through exits at the inner periphery of the seal body.

Similar "tortuous path" cooling schemes are utilized spaced from this first cooling scheme in a direction toward the leading edge, however, the spaced cooling schemes extend for a lesser distance such that the overall pressure drop decreases.

In the disclosed embodiment, and adjacent the leading edge, a distinct type cooling scheme is utilized wherein the tortuous paths are replaced by a plurality of pedestals within an open space. The pedestals increase the heat transfer surface area, but do not result in as much pressure drop as the tortuous path type cooling schemes mentioned above.

As known, typically, dozens of blade outer air seal sections are placed together circumferentially adjacent to other blade outer air seal sections. A cooling scheme is utilized adjacent one lateral edge of each section of blade outer air seal to provide cooling air at a relatively high pressure into a gap between adjacent sections. The cooling air supplied into the gap provides purge air to resist leakage of the products of combustion through this gap.

These and other features of the present invention can be best understood from the following specification and drawings, the following of which is a brief description.

DETAILED DESCRIPTION OF THE PREFERRED EMBODIMENT

Figure 1:
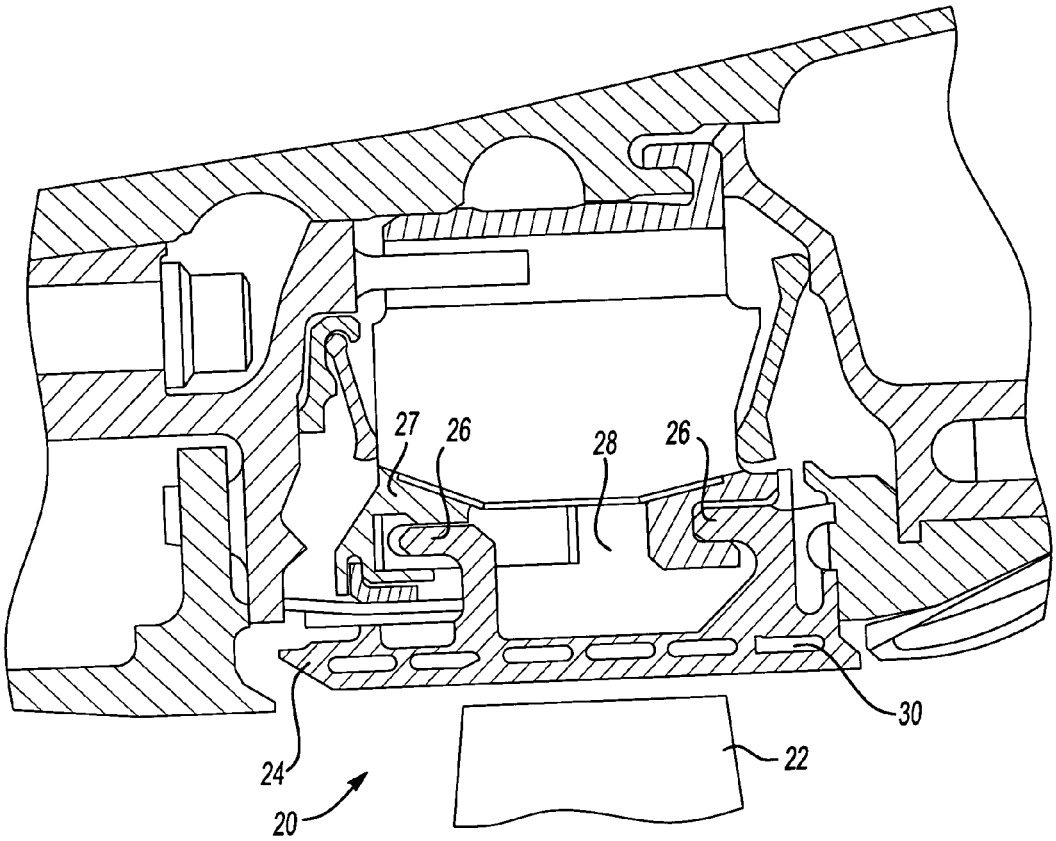
Fig-1 PRIOR ART
FIG. 1 shows a portion of a prior art gas turbine engine.

FIG. 1 shows a portion of a gas turbine engine 20 having rotating turbine blades 22, and a blade outer air seal 24 spaced slightly radially outwardly of the outermost portion of the turbine blade 22. As shown, hooks 26 hold the blade outer air seal 24 into a housing 27. As known, typically, dozens of sections of the blade outer air seal 24 are positioned circumferentially adjacent to each other to surround the turbine blades 22 and their rotor.

An air space 28 supplies air to a plurality of cooling channels 30 formed within a body of the blade outer air seal 24. In general, these cooling channels 30 have been relatively thick in a radially outwardly extending dimension. Further, only one type of cooling scheme has been utilized throughout the blade outer air seal. As mentioned above, the cooling challenges and the fluid dynamics faced by the cooling air change as one moves from a leading edge of the blade outer air seal 24 toward a trailing edge (from left to right in FIG. 1).

Figure 2:
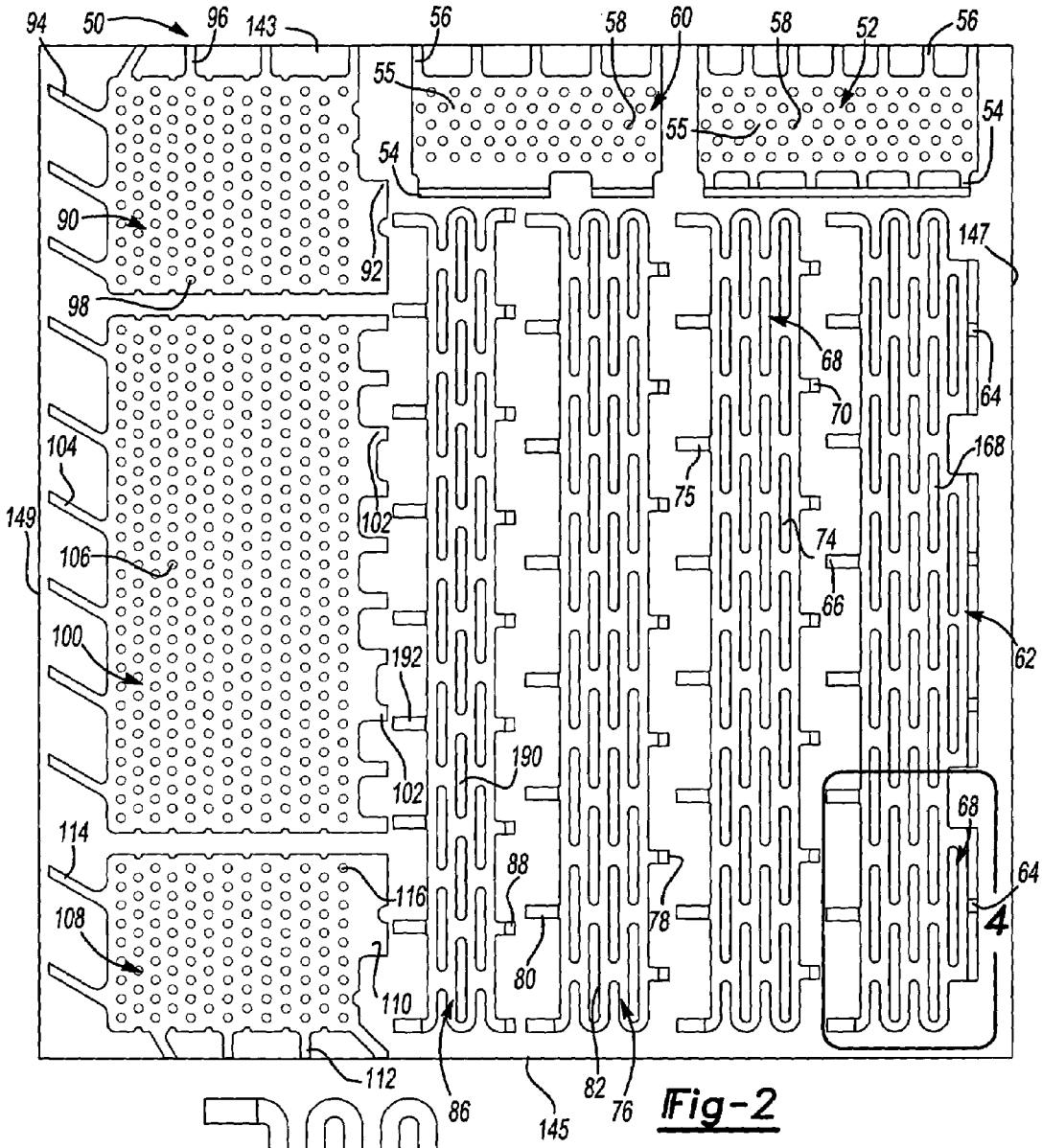
FIG. 2 is a plan view of a number of cooling schemes within an example blade outer air seal.

FIG. 2 is a cross-section through an inventive blade outer air seal section 50 having a leading edge 149 and a trailing edge 147. Sides 145 and 143 sit adjacent to another section of blade outer air seal 50 when the blade outer air seal is assembled within a gas turbine engine. As shown in this figure, there are nine distinct internal cooling passages within the blade outer air seal 50.

A first cooling scheme is provided by section 52. Section 52 has inlet ports 54 that extend to a radially outer surface on the blade outer air seal body 50. The cooling air passes into the inlets 54, into an enlarged open space 55, and over pedestals 58 before passing outwardly through outlets 56 in the side wall 143. The pedestal type cooling schemes result in a relatively low pressure drop, and thus relatively high pressure air will be exiting the outlets 56 and into the gap between this blade outer air seal section 50 and an adjacent one. In this manner, the relatively high pressure air will purge leakage air away from the gap. The pedestals, as known, increase the heat transfer cross-sectional area and turbulence to provide more efficient and effective cooling. The section 52 is a compact heat exchanger section that is formed to be very thin in a radially outer dimension (into the plane of FIG. 2). In this manner, relatively small cooling sections can be provided and can be tailored to the individual challenges of a particular area on the blade outer air seal 50.

Another section 60 is spaced toward the leading edge 149 from the section 52. Section 60 is configured to be much like section 52, however, as can be appreciated, the gap between pedestals 58 is enlarged toward the leading edge, as such, the pressure drop is made to be less as one moves closer to the leading edge.

Another section 62 is formed adjacent the trailing edge. Section 62 is supplied with cooling air from inlets 64, and that cooling air passes through a tortuous path around elongated strips 168, and outwardly of outlets 66 in an inner peripheral surface of the blade outer air seal body 50. This cooling air passes into the flow path of the products of combustion passing over the turbine.

Figure 3:
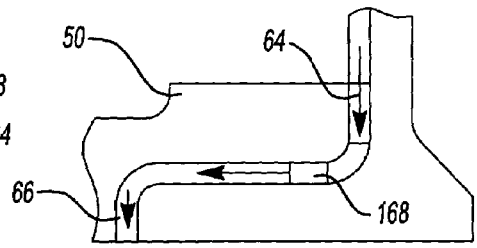
FIG. 3 is a cross-sectional view along a portion of the FIG. 2 scheme.

As can be appreciated from FIG. 3, the inlet 64 extends to the outer periphery, the air passes over the strips 168, and out of the outlet 66.

Another cooling air section 68 receives air from an inlet 70, passes air over elongated strips 74, and outwardly through the outlet 75. Another section 76 has inlet 78, strips 82, and outlet 80. Yet another section 86 has inlet 88, strips 190 and outlet 192.

As can be appreciated from FIG. 2, the length of the sections 62, 68, 76 and 86 decreases as one moves from the trailing edge 147 towards the leading edge 149. Again, this is because it would be desirable to reduce the overall pressure drop since the air must exit closer to the leading edge where the pressure ratio is lower.

Figure 4:
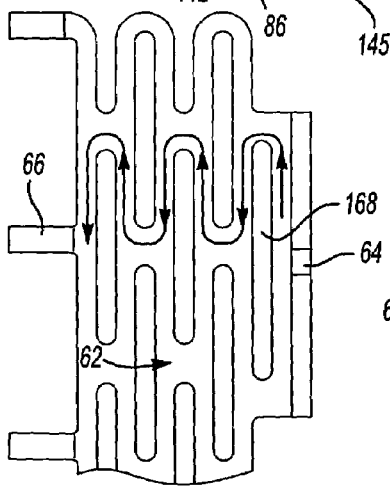
FIG. 4 is an enlarged portion of FIG. 2, along the circle 4.

As shown in FIG. 4, each of these cooling scheme sections provide a tortuous path with the air having to pass around the elongated strips.

Another cooling air section 90 is positioned adjacent the side 143, and at the leading edge 149. Section 90 has inlets 92, and delivers through an open space over pedestals 98, and outwardly through side outlets 96, and forward outlets 94. Side outlets 96 extend to the side 143, whereas forward outlets 94 extend to the inner peripheral surface of the blade outer air seal body 50.

Another section 100 has inlets 102, outlets 104, and pedestals 106. Yet another section 108 has inlets 110, side outlets 112, forward outlets 114, and pedestals 116. Sections 90, 100 and 108 are all of the low pressure drop pedestal type, and thus do not reduce the pressure drop of the cooling air to a great extent such that it can exit into the working air, or the products of combustion.

A designer of a blade outer air seal can take advantage of the power provided by this invention to individually tailor cooling sections for the challenges faced by the particular area on a blade outer air seal. By utilizing this plurality of distinct type cooling schemes, the present invention provides more efficient and effective cooling.

Figure 5:
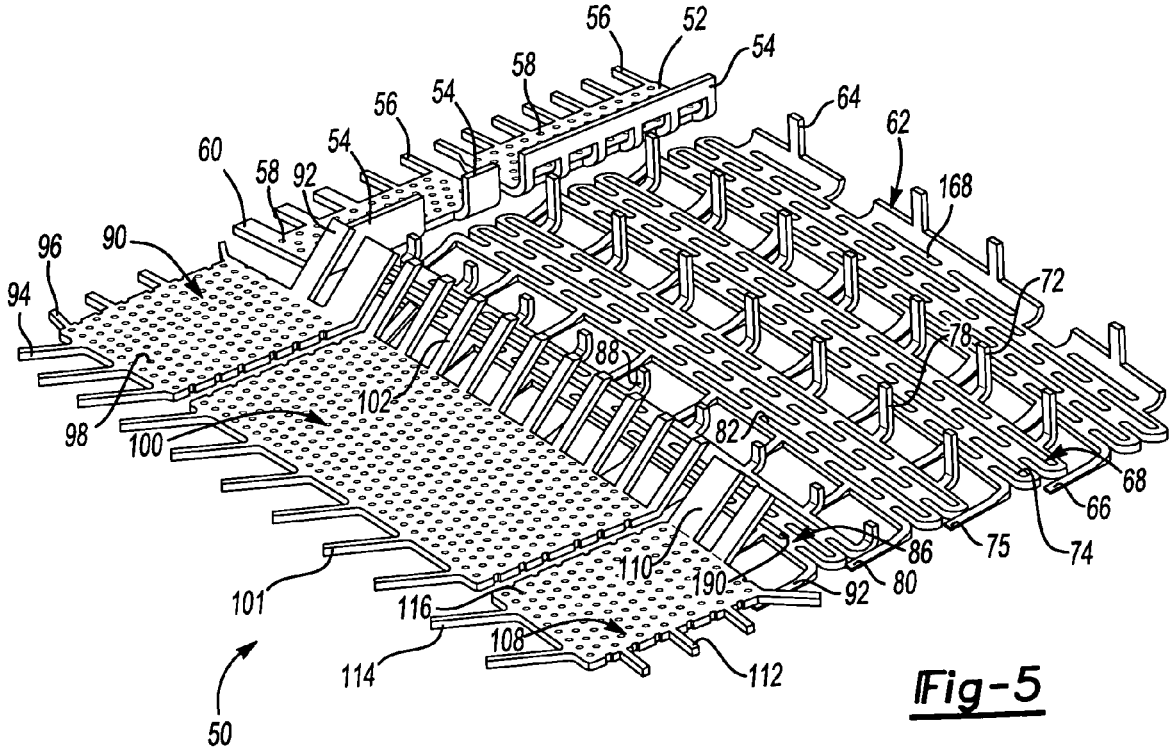
FIG. 5 shows a lost core for forming the various cooling schemes illustrated in FIG. 2.

The compact heat exchangers disclosed in this invention may be formed by a lost core mold technique. A core body is shown in FIG. 5. FIG. 5 can also assist one in appreciating aspects of the shapes of the inlets and outlets, which may not be readily understandable from the plan view of FIG. 2.

It should be appreciated that FIG. 5 actually shows a "mirror" of the cooling passages of FIG. 2. What FIG. 5 shows is a core that will be put within a mold for forming the blade outer air seal. Once material has formed around this core, the core may be leached out of the material for forming the body, leaving cavities to provide the cooling air passages. FIG. 5 includes reference numerals which are identical to those shown in FIG. 2, even though what is actually shown in FIG. 5 is this core rather than the actual cooling passages.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A blade outer air seal comprising:

a body extending between two circumferential sides, and between a leading edge and a trailing edge;

at least two distinct types of cooling circuits provided within said body to utilize fluid to cool said body;

a first type of cooling circuit having a relatively great pressure drop is positioned adjacent said trailing edge, and a second type of cooling circuit having a lesser pressure drop than said first type is positioned adjacent said leading edge; and said first and second type of cooling circuits utilizing distinct cooling schemes, and having different shaped structures.

2. The blade outer air seal as set forth in claim 1, wherein said second type of cooling circuit includes an inlet extending through an outer peripheral surface of said body to supply air into an enlarged open space, and a plurality of pedestals formed within said enlarged open space such that air passes from said inlets into said space, over said pedestals, and outwardly through an outlet in an inner peripheral surface of said body.

3. The blade outer air seal as set forth in claim 2, wherein there are a plurality of lower pressure drop cooling circuits having a similar structure as said second type, and spaced along said leading edge between said two circumferential sides.

4. The blade outer air seal as set forth in claim 3, wherein there are side cooling circuits having a similar structure as said second type adjacent at least one of said circumferential sides, and having outlets extending through a side wall to supply air into a gap between adjacent blade outer air seal sections.

5. A blade outer air seal comprising:

a body extending between two circumferential sides, and between a leading edge and a trailing edge;

at least two distinct types of cooling circuits provided within said body to utilize fluid to cool said body;

a first type of cooling circuit having a relatively great pressure drop is positioned adjacent said trailing edge, and a second type of cooling circuit having a lesser pressure drop than said first type is positioned adjacent said leading edge; and said first type of cooling circuit has an inlet extending to a radially outer location on said body, and supplying air into a tortuous path around a plurality of elongated strips, and through an outlet extending through an inner peripheral surface of said body.

6. The blade outer air seal body as set forth in claim 5, wherein there are a plurality of higher pressure drop cooling circuits having a similar structure as said first type and spaced adjacent to one an other in a direction from said trailing edge and toward said leading edge.

7. The blade outer air seal as set forth in claim 6, wherein a length of said higher pressure drop cooling air circuits decreases in said direction from said trailing edge toward said leading edge.

8. A blade outer air seal comprising:

a body extending between two circumferential sides, and between a leading edge and a trailing edge;

at least two distinct types of cooling circuits provided within said body to utilize fluid to cool said body;

a first type of cooling circuit having a relatively great pressure drop is positioned adjacent said trailing edge, and a second type of cooling circuit having a lesser pressure drop than said first type is positioned adjacent said leading edge; and said second type of cooling circuit includes an inlet extending through an outer peripheral surface of said body to supply air into an enlarged open space, and a plurality of pedestals formed within said enlarged open space such that air passes from said inlets into said space, over said pedestals, and outwardly through an outlet in a side wall of said body.

9. A turbine engine comprising:

a combustion section;

a turbine section, including a turbine rotor rotating about an axis;

a blade outer air seal radially outwardly of said turbine rotor, said blade outer air seal formed of a plurality of circumferential spaced sections, each section including a body extending between two circumferential sides, and between a leading edge and a trailing edge and at least two distinct types of cooling circuits provided within said body to utilize fluid to cool said body;

a first type of cooling circuit having a relatively great pressure drop is positioned adjacent said trailing edge, and a second type of cooling circuit having a lesser pressure drop than said first type is positioned adjacent said leading edge; and said first and second type of cooling circuits utilizing distinct cooling schemes, and having different shaped structures.

10. The turbine engine as set forth in claim 9, wherein said first type of cooling circuit has an inlet extending to a radially outer location on said body, and supplying air into a tortuous path around a plurality of elongated strips, and through an outlet extending through an inner peripheral surface of said body.

11. The turbine engine as set forth in claim 10, wherein there are a plurality of higher pressure drop cooling circuits having a similar structure as said first type and spaced adjacent to one an other in a direction from said trailing edge and toward said leading edge.

12. The turbine engine as set forth in claim 11, wherein a length of said higher pressure drop cooling air circuits decreases in said direction from said trailing edge toward said leading edge.

13. The turbine engine as set forth in claim 9, wherein said second type of cooling circuit includes an inlet extending through an outer peripheral surface of said body to supply air into an enlarged open space, and a plurality of pedestals formed within said enlarged open space such that air passes from said inlets into said space, over said pedestals, and outwardly through an outlet in an inner peripheral surface of said body.

14. The turbine engine as set forth in claim 13, wherein there are a plurality of lower pressure drop cooling circuits having a similar structure as said second type, and spaced along said leading edge between said two circumferential sides.

15. The turbine engine as set forth in claim 14, wherein there are side cooling circuits having a similar structure as said second type adjacent at least one of said circumferential sides, and having outlets extending through a side wall to supply air into a gap between adjacent blade outer air seal sections.

16. The turbine engine as set forth in claim 9, wherein said second type of cooling circuit includes an inlet extending through an outer peripheral surface of said body to supply air into an enlarged open space, and a plurality of pedestals formed within said enlarged open space such that air passes from said inlets into said space, over said pedestals, and outwardly through an outlet in a side wall of said body.

17. The turbine engine as set forth in claim 9, wherein said first type of cooling circuit supplies air through a torturous path along a plurality of elongated strips, and said second type of cooling circuit supplies air into an enlarged open space with a plurality of pedestals formed within said enlarged open space, such that air in said first type of cooling circuit encounters distinct structure than air in said second type cooling circuit.

18. A blade outer air seal comprising:

a body extending between two circumferential sides, and between a leading edge and a trailing edge;

at least two distinct types of cooling circuits provided within said body to utilize fluid to cool said body;

a first type of cooling circuit having a relatively great pressure drop is positioned adjacent said trailing edge, and a second type of cooling circuit having a lesser pressure drop than said first type is positioned adjacent said leading edge; and first type of cooling circuit supplies air through a torturous path along a plurality of elongated strips, and said second type of cooling circuit supplies air into an enlarged open space with a plurality of pedestals formed within said enlarged open space, such that air in said first type of cooling circuit encounters distinct structure than air in said second type cooling circuit.

* * * * *

UNITED STATES PATENT AND TRADEMARK OFFICE

CERTIFICATE OF CORRECTION

PATENT NO. : 7,621,719 B2
APPLICATION NO. : 11/240192
DATED : November 24, 2009
INVENTOR(S) : Lutjen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1088 days.

Signed and Sealed this

Fourteenth Day of December, 2010

David J. Kappos

David J. Kappos
*Director of the United States Patent and Trademark Office*